US006397804B1

(12) United States Patent
Harada et al.

(10) Patent No.: US 6,397,804 B1
(45) Date of Patent: Jun. 4, 2002

(54) VALVE DRIVE MECHANISM FOR ENGINE

(75) Inventors: Setsuo Harada; Hiroyuki Oda; Hirokazu Matsuura; Kouji Asanomi; Masayuki Saiki, all of Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 09/927,618

(22) Filed: Aug. 10, 2001

(30) Foreign Application Priority Data

Aug. 11, 2000 (JP) ..... 2000-245022

(51) Int. Cl.[7] ..... F01L 13/00

(52) U.S. Cl. ..... 123/90.16; 123/90.17; 123/90.5

(58) Field of Search ..... 123/90.15, 90.16, 123/90.17, 90.48, 90.5, 198 F; 74/569

(56) References Cited

U.S. PATENT DOCUMENTS 5,090,364 A 2/1992 McCarroll et al.
5,287,830 A 2/1994 Dopson et al.
5,343,833 A * 9/1994 Shirai ..... 123/90.16
5,709,180 A * 1/1998 Spath ..... 123/90.16
6,125,804 A * 10/2000 Kawai et al. ..... 123/90.16

FOREIGN PATENT DOCUMENTS

JP 07-071213 3/1995
JP 10-141030 5/1998

* cited by examiner

*Primary Examiner*—Weilun Lo
(74) *Attorney, Agent, or Firm*—Brooks & Kushman

(57) ABSTRACT

A valve drive mechanism includes a generally cylindrically shaped tappet assembly (24) comprising a center tappet (41 ) and a side tappet (42). The center tappet (41 ) has a circular-arcuate side walls (41*c*) formed with vertical side shrouds (41*d*) at opposite sides of each side wall (41*c*) which overlap and slide contact with opposite end guide walls (42*h*) of the side tappet (42), respectively. When the tappet assembly (24) is in an unlocked state so as to transmit rotation of the side cams (25, 27), the vertical side shroud (41*d*) of the center tappet (41 ) slide on the vertical side walls (42*h*) of the side tappet 42 so as thereby to guide slide movement of the center tappet (41) relative to the side tappet (42).

21 Claims, 12 Drawing Sheets

VALVE DRIVE MECHANISM FOR ENGINE

BACKGROUND OF THE INVENTION

1. Field of the Invention

The present invention relates to a valve drive mechanism for an engine which is variable in valve lift and has a valve lifter or tappet which selectively transmits rotation of different cams of different lift cams.

2. Description of Related Art

There has been known various valve drive mechanisms which can drive valves with variable valve lifts. For example in U.S. Pat. No. 5,287,830 a valve drive mechanism has a center tappet and a side tappet arranged coaxially with each other and couples them together by a hydraulically operated locking/unlocking pin for high speed engine operation with a high lift cam and uncoupled from one another by the hydraulically operated locking/unlocking pin for low speed engine operation with low lift cams. In Japanese Unexamined Patent Publication No. 10-141030 a cylindrically shaped tappet is divided into three parts in a rotational direction of cams. Further, in Japanese Unexamined Patent Publication No. 7-71213 a shim is divided into three parts.

The tappet disclosed in U.S. Pat. No. 5,287,830 comprises a cylindrical center tappet and a side tappet which coaxially surrounds the cylindrical center tappet. This cylindrical configuration of the tappet has restraints on the length of the center tappet as a cam follower. In order to avoid such a restraint, it is proposed to incorporate a center tappet having an elongated top. However, this alternative center tappet increases the height of the tappet. The tappet disclosed in Japanese Unexamined Patent Publication No. 10-141030 or Japanese Unexamined Patent Publication No. 7-71213 has the drawback that, since a circumferential outer wall at an edge of an interface of the side tappet with the center tappet causes contact slide on a wall of a tappet guide bore formed in a cylinder head in other words, since the center tappet is not subjected to a force by the cam, while the side tappet is driven by side cams, there occurs a rise in pressure between the side tappet and tappet guide bore, which results in uneven abrasion of the tappet and tappet guide.

SUMMARY OF THE INVENTION

It is therefore an object of the present invention to provide a valve drive mechanism which enables a large cam follower length of a tappet and lowers a force that is caused due to an inclination of the tappet and is exerted on a tappet guide from the tappet.

The above object of the present invention is accomplished by a valve drive mechanism including one center cam which has a center cam lobe per valve and a pair of side cams which have side cam lobes, respectively, different from the center cam lobe per valve and are arranged on a camshaft on opposite sides of the center cam in an axial direction of the camshaft, a generally cylindrically shaped tappet assembly which is movable in a direction of valve lift and comprises two mating parts, and locking/unlocking means for mechanically coupling the two mating parts together and uncoupling the two mating parts from each other so as to selectively transmit rotation of the center cam and the side cams as reciprocating movement to the valve. The valve drive mechanism comprises a center tappet, forming one of the two mating parts and driven by the center cam; which is formed with opposite circular-arcuate vertical side walls in a rotational direction of the camshaft, a side tappet, forming another one of the two mating parts and driven by the side cams, which is divided into two side tappet parts in the axial direction of the camshaft between which the center tappet is received for slide movement relative to the side tappet in said direction of valve lift and is formed at the side tappet parts with opposite circular-arcuate vertical end walls, respectively, such that the circular-arcuate vertical side walls of the center tappet and the circular-arcuate vertical end walls of the side tappet form a generally cylindrical configuration of the tappet assembly, and guide means for guiding the slide movement of the center tappet relative to the side tappet which comprises a vertical flat side wall extending continuously from each of opposite sides of each circular-arcuate end wall of the side tappet in the rotational direction of the camshaft and a vertical shroud extending continuously from each of opposite ends of each circular-arcuate side wall of the center tappet in the axial direction of the camshaft and forming thereon a vertical flat side surface. The vertical shroud at the vertical flat side surface is slidable on the vertical flat side wall so as thereby to guide the slide movement of the center tappet relative to the side tappet.

In the valve drive mechanism which preferably includes the center cam having a high lift cam lobe and the side cam having a low lift cam lobe, the two side tappet parts are joined by a connecting bridge at which the tappet assembly is engaged by a valve stem of the valve. This connecting bridge is formed with a spring receiving recess in which a return spring is received so as to force the center tappet to return when the center tappet slides relatively to the side tappet. Further, the connecting bridge may be provided with at least one oil spill port formed at a bottom of the spring receiving recess. A shim may be disposed between the connecting bridge and the valve stem.

The locking/unlocking means may preferably comprise guide bores which are formed in each the center tappet and each the side tappet part of the side tappet and are in alignment with one another in the direction of the rotational axis of camshaft, a locking/unlocking pin received for slide movement in the guide bore of the center tappet, a plunger received for slide movement in the guide bore of one of the two side tappet parts of the side tappet, a spring loaded receiver received for slide movement in the guide bore of another of the two side tappet parts of the side tappet, and an oil channel formed in the one side tappet part of the side tappet so as to communicate with the guide bore of the one of the two side tappet parts of the side tappet, through which hydraulic oil is introduced into and removed from the guide bore of the one side tappet part of the side tappet. The hydraulic oil is supplied into the guide bore of the one side tappet part of the side tappet through the oil channel so as to force the plunger and the locking/unlocking pin to slide against the spring loaded receiver and to partly enter the guide bores of the center tappet and the other side tappet part of the side tappet, respectively, thereby mechanically coupling the center tappet to the side tappet together and is removed from the guide bore of the one side tappet part of the side tappet through the oil channel so as to cause the plunger and the locking/unlocking pin to slide back by the spring loaded receiver, thereby mechanically uncoupling the center tappet from the side tappet. The locking/unlocking pin is preferably formed with a circumferential recess.

The tappet assembly may includes a stopper in the guide bore in which the plunger is received so as to limit the slide movement of the plunger in the guide bore and to close the guide bore at one end. In this case, the guide bore is communicated with the oil channel through a connecting oil channel.

The valve drive mechanism includes oil supply means comprising oil galleries which extend along the intake camshaft and the exhaust camshaft, respectively, branch oil channels which branch off from the oil galleries, respectively and extend between two tappet assemblies for twin intake valves and two tappet assemblies for twin exhaust valves for each cylinder, oil channels each of which is formed in an outer wall of the side tappet and is in communication with the branch oil channel. The plunger in the guide bore of the one side tappet part of the side tappet operates to bring the center tappet and the side tappet into a locked or mechanically coupled condition when pressure of hydraulic oil is supplied to the plunger from the oil gallery through the oil channel via the branch oil channel and into an unlocked or mechanically uncoupled condition when the pressure of hydraulic oil is removed from the plunger.

The branch oil channel preferably extends such as to partly overlap outer peripheries of the two tappet assemblies for the twin intake valves or the twin exhaust valves, and the oil channel has a length sufficient to remain communicated with the branch oil channel during up and down movement of the tappet assembly.

The branch oil channel may be formed by drilling a cylinder head to the oil gallery from one side of the cylinder head and plugged at the one side of the cylinder head.

The valve drive mechanism may further comprise a member operative to prevent the tappet assembly from turning relative to the cylinder head during installing the tappet assembly in the valve drive mechanism. The member is provided on an outer wall of the side tappet at one of opposite sides of the tappet assembly remote from the branch oil chamber.

The valve drive mechanism may further comprises retaining means provided between the center tappet and the side tappet for preventing the center tappet from moving up beyond a top of the side tappet by the return spring and however for allowing down movement of the center tappet with respect to the side tappet against the return spring. Specifically, the retaining means comprises a retaining pin extending between the center tappet and the side tappet, a supporting bore in which the retaining pin is removably received and a limiting recess engageable with the retaining pin which limits the down movement of the center tappet, the supporting bore being formed in either one of the center tappet and the side tappet and the limiting recess being formed in another one of the center tappet and the side tappet.

According to the valve drive mechanism, the tappet assembly has the vertical shroud which extends, preferably along almost the entire vertical length of the center tappet, continuously from each of opposite sides of each circular-arcuate vertical side wall of the center tappet in the axial direction of the camshaft, slide movement of the center tappet relative to the side tappet is guided by the vertical shrouds sliding on the vertical flat side wall of the side tappet, respectively. This structure of the tappet assembly enables a large cam follower length of the tappet assembly. In addition, the tappet assembly thus structured disperses a force, which presses the side tappet against the guide wall of the tappet guide, toward the center tappet through the vertical shrouds while the side tappet is driven by the side cams, so that the side tappet slides on the tappet guide through the outer wall of the center tappet that is perpendicular to a direction in which the force presses the side tappet against the wall of the tappet guide. As a result, there is no concentration of pressing force that occurs at circumferential outer edges of an interface with the center tappet in the conventional valve drive mechanisms. In addition, the force that is caused due to an inclination of the tappet and is exerted on the tappet guide from the tappet is lowered.

The valve drive mechanism has the cam arrangement in which the high lift center cam is disposed between the low lift side cams enables a large cam follower length of the tappet assembly. This cam arrangement is quite advantageous to high lift operation. In addition to the cam arrangement, the valve drive mechanism has the side tappet structure in which the two side tappet parts are joined by the connecting bridge engageable with the valve stem and the return spring is received in the recess formed in the connecting bridge so as to force the center tappet to return. This side tappet arrangement keeps the center tappet ridden on the center cam while the center tappet is uncoupled from the side tappet. This prevents an occurrence of rattling noises due to repeated collisions of the center tappet with the center cam during floating action of the center tappet and, in addition, provides the tappet assembly with compactness.

The locking/unlocking means that comprise guide bores formed in the center tappet and the side tappet, a locking/unlocking pin received for slide movement in the guide bore of the center tappet, a plunger received for slide movement in the guide bore of one of the two side tappet parts, a spring loaded receiver received for slide movement in the guide bore of another one of the two side tappet parts, and an oil channel formed in the one side tappet part so as to communicate with the guide bore of the one side tappet part through which hydraulic oil is introduced into and removed from the guide bore of the one side tappet part. This locking/unlocking means operates such that, when hydraulic oil is supplied into the guide bore of the one side tappet part through the oil channel, the locking/unlocking means forces the plunger and the locking/unlocking pin to slide against the spring loaded receiver and to partly enter the guide bores of the center tappet and the other side tappet part, respectively, thereby mechanically coupling the center tappet to the side tappet together and, when the hydraulic oil is removed from the guide bore of the one side tappet part through the oil channel, the locking/unlocking means causes the plunger and the locking/unlocking pin to slide back by the spring loaded receiver, thereby mechanically uncoupling the center tappet from the side tappet. This hydraulically operated mechanism of the locking/unlocking means can couple the center tappet to the side tappet together in a state where the engine operates at a high speed and, in consequence, a high hydraulic pressure is provided assuredly. This prevents an occurrence of unstable mechanical coupling of the center tappet to the side tappet due to an insufficient hydraulic pressure.

The locking/unlocking pin formed with a circumferential recess decreases an area of contact surface with the guide bore, so as to lower frictional resistance between the locking/unlocking pin and the guide bore.

The valve drive mechanism includes the oil channel arrangement for the tappet assembly which comprises the oil galleries extending along the intake camshaft and the exhaust camshaft, respectively, branch oil channels branching off from the oil galleries, respectively and extending between the two adjacent tappet assemblies for the twin intake valves and the two adjacent tappet assemblies for the twin exhaust valves for each cylinder, oil channels each of which is formed in an outer wall of the side tappet and is in communication with the branch oil channel. Further, in the oil channel arrangement, the branch oil channel extends such as to partly overlap outer peripheries of the two tappet assemblies for the twin intake valves or the twin exhaust valves, and the oil channel has a length sufficient to remain communicated with the branch oil channel during up and down movement of the tappet assembly. The oil channel arrangement has one branch oil channel used commonly to both the two adjacent tappet assemblies. This avoids drilling the branch oil channel per the tappet guide, which leads to a reduction in man-hour for forming the branch oil channel. In addition, the oil channel arrangement is easily formed.

BRIEF DESCRIPTION OF DRAWINGS

The foregoing and other objects and features of the present invention will become more apparent from the following description in connection with the preferred embodiments thereof when considering in conjunction with the accompanying drawings, in which the same reference numerals have been used to denote same or similar parts throughout the accompanying drawings, and wherein.

DETAILED DESCRIPTION OF THE INVENTION

In the following description the terms "front end" and "rear end" shall mean and refer to front and rear ends of an engine, respectively, as viewed in a direction in which a row of cylinders is arranged, and the terms "front side" and "rear side" of the engine shall mean and refer to the front and rear sides, respectively, as viewed in a lengthwise direction of a vehicle body.

Figure 1:
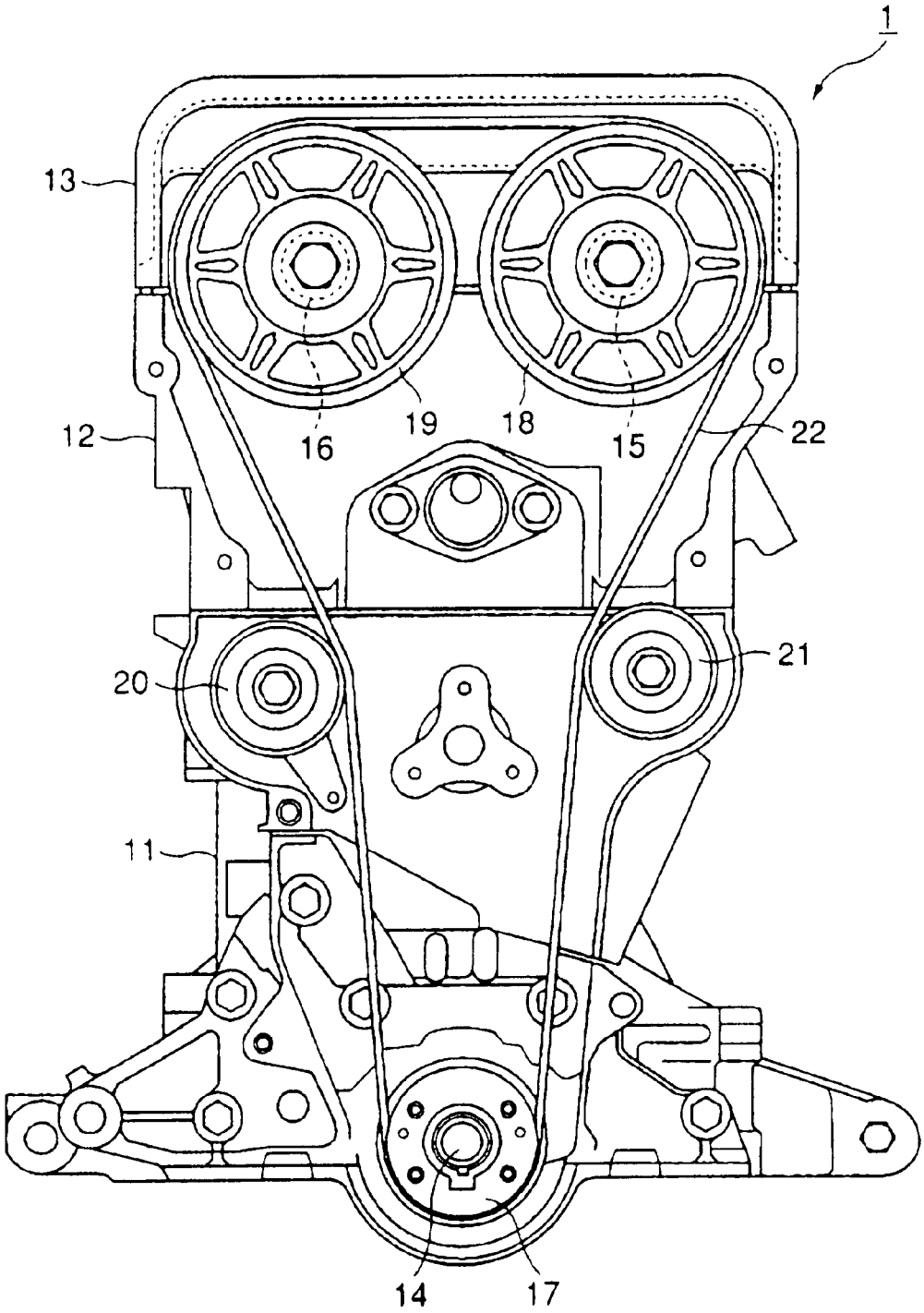
FIG. 1 is an end view of an engine equipped with a valve drive mechanism in accordance with n embodiment of the present invention.

Referring to the drawings in detail, and in particular to FIG. 1 which shows an internal combustion engine 1 equipped with a valve drive mechanism according to the present invention, the engine 1 is of an in-line four cylinder type that has double overhead camshafts. The engine 1, which is mounted in an engine compartment so that the camshafts extend in a transverse direction of the engine compartment, has an engine body comprising a cylinder block 11, a cylinder head 12 and a head cover 13. A crankshaft 14 is disposed at the bottom of the cylinder block 14 and axially extends beyond a front end of the cylinder block 11. Camshafts, namely an intake camshaft 15 and an exhaust camshaft 16 are disposed over the cylinder head 12 and axially extend beyond the front end of the cylinder head 12. The crankshaft 14 is provided with a crankshaft pulley 17 secure to one end thereof. The intake camshaft 15 is provided with a camshaft pulley 18 secure to one end thereof extending beyond the front end of the cylinder head 12. Similarly, the exhaust camshaft 16 is provided with a camshaft pulley 19 secure to one end thereof extending beyond the front end of the cylinder head 12. The cylinder block 11 is provided with a tension pulley 20 and an idle pulley 21 pivotally mounted to the front end thereof. The intake camshaft 15 and the exhaust camshaft 16 are turned by a timing belt 22. The tension pulley 20 is adjustable in position so as to apply desired tension to the timing belt 22. The camshafts 15 and 16 turn one-half crankshaft speed.

Figure 2:
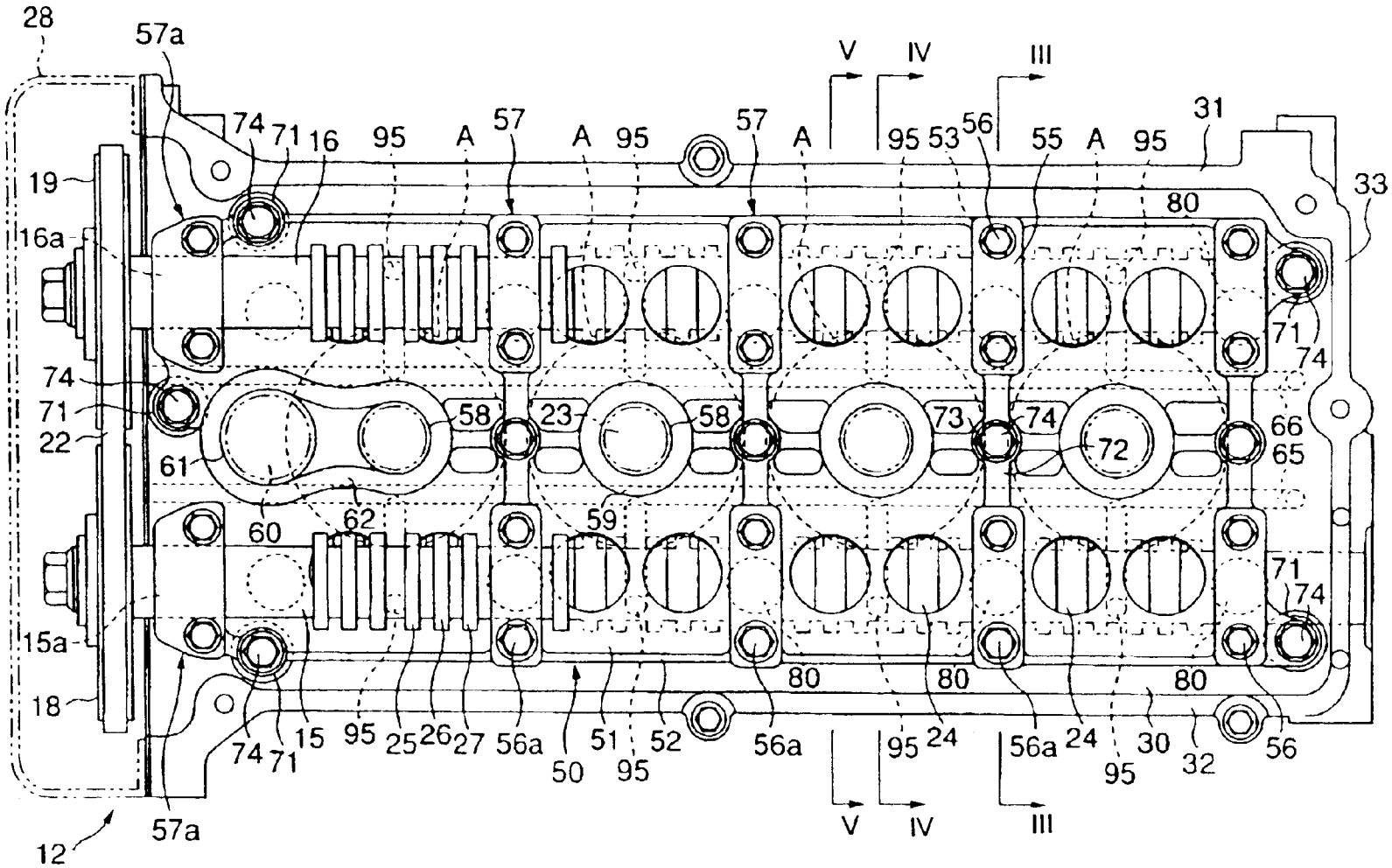
FIG. 2 is a top view of the engine with a cylinder head cover removed.

Referring to FIGS. 2 to 5 which show a top of the cylinder head 12, a vertical cross-section of the cylinder head 12 as viewed along line III—III of FIG. 2, a vertical cross-section of the cylinder head 12 as viewed along line IV—IV of FIG. 2, and a vertical cross-section of the cylinder head 12 as viewed along line V—V of FIG. 2, respectively, the camshafts 15 and 16 extend in parallel with each other in the transverse direction. There is one spark plug 23 on the cylinder head 12 for each cylinder A in the engine 1. The engine 1 has four valves, namely two intake valves 39 and two exhaust valves 40, per cylinder A. These valves 39 and 40 are driven at appropriate timings by the camshafts 15 and 16 to open and close intake ports 34 and exhaust ports 35, respectively. The valve train includes a valve lifter or tappet assembly 24 installed between a cam lobe of the camshaft 15, 16 and a valve stem 81 of the valve 39, 40. The lower end of the tappet assembly 24 is in contact with the cam lobe and slid up and down when the camshaft 15, 16 turns.

The intake camshaft 15 has two low lift side cams 25 and 27 and one high lift center cam 26 for each intake valve 39. Similarly, the exhaust camshaft 16 has two low lift side cams 25 and 27 and one high lift center cam 26 for each exhaust valve 40. The low lift side cams 25 and 27 have the same shape of lobes. The high lift center cam 26 has a lobe different in shape from those of the low lift side cams 25 and 27 and is interposed between the low lift side cams 25 and 27. The cam lobe of high lift center cam 26 is in contact with a center portion of the tappet assembly 24 (which is hereafter referred to as a center tappet 41 and will be described in detail later) The cam lobes of low lift side cams 25 and 27 are in contact with side portions of the tappet assembly 24 (which are hereafter referred to as a side tappet 42 and will be described in detail later) at opposite sides of the center portion. The low lift side cam 25, 27 has a smaller lobe lower than that of the high lift center cam 26.

The cylinder head 12 comprises a base portion 30 and front side, rear end and rear side shrouds 31, 32 and 33 extending vertically from the front side, rear end and rear side peripheries of the base portion 30. The front side, rear end and rear side shrouds 31, 32 and 33 are formed as a continuous wall. The engine 1 has a front cover 28 that covers front ends of the cylinder block 11, the cylinder head 12 and the head cover 13 so as to protect a camshaft drive mechanism including the crankshaft pulley 17 the camshaft pulleys 18 and 19, the tension pulley 20, the idle pulley 21 and the timing belt 22. The cylinder head 12 is formed with an upper portion of combustion chamber B, the intake ports 34, the exhaust ports 35 and a plug hole 36 per cylinder A all of which are bored in the cylinder head base portion 30. The cylinder head 12 at opposite sides is provided with an intake manifold 37 and an exhaust manifold 38 mounted to the cylinder head base portion 30.

There is a cam carrier 50 on the cylinder head base portion 30. The cam carrier 50 comprises a horizontal base plate 51 disposed in a space that is formed over the cylinder head base portion 30 by the continuous shrouds 31, 32 and 33 and a peripheral shroud 52 extending along the almost entire periphery of the horizontal base plate 51 such as to provide a box-shaped configuration. Journal bearings 57 are located such that the journal bearings 57 are on each of the opposite sides of a straight row of the cylinder A as viewed in the longitudinal direction of the vehicle body and that there is one journal bearing 57 per camshaft behind each cylinder A as viewed in the transverse direction of the vehicle body. The journal bearings 57 support the intake camshaft 15 and the exhaust cam shaft 16 at their journals 15*a* and 16*a*, respectively, for rotation. The journal bearing 57 comprises a bearing lower block 53 formed as an integral part of the horizontal base plate 51 and a bearing upper block 55 secured to the bearing lower block 53 by fastening bolts 56 and 56*a*. The each pair of bearing lower blocks 53 for the intake camshaft 15 and the exhaust camshaft 16 are interconnected by a bridge 72 formed as an integral part of the horizontal base plate 51. In this instance, the journal bearings 57 are basically identical in configuration and arranged at regular intervals. However, the foremost journal bearings 57*a* are slightly different in configuration from the remaining journal bearings 57 and located closely to the camshaft pulleys 18 and 19, respectively.

There is one tappet guide 54 formed in the horizontal base plate 51 per cylinder A in which the tappet assembly 24 is received for slide movement therein. The tappet guide 54 is such an inclined cylindrical bore as to extend through the horizontal base plate 51. The tappet assembly 24 slides up and down in the tappet guide 54 following rotation of the cams 25–27 so as to lift up and down the intake valve 39 or the exhaust valve 40. There is further a guide bore 58 formed in the horizontal base plate 51 as a guide way for the spark plug 23 when the spark plug 23 is fixedly mounted in the plug hole 36. Specifically, the spark plug guide bore 58, except the foremost one, is formed such as to pass through a cylindrical column 59 vertically extending above the center of each cylinder A from the horizontal base plate 51. As seen in FIG. 2, the spark plug guide bore 58 associated with the foremost cylinder A is formed in a cocoon-shaped column 62. A bore 61 is also formed in the column 62 so as to receive a hydraulic oil supply control valve 60 operative to supply hydraulic oil to the tappet assembly 24.

The head cover 13 is brought into contact with the cylinder head 12 along the top surfaces of shrouds 13–33 extending vertically from the base portion 30, and the top surfaces of the columns 59 and 62 vertically extending from the horizontal base plate 51 and fixedly attached to the cylinder head 12.

The horizontal base plate 51 has ribs 63 and 64 extending in a direction from the front end to the rear end of the engine 1. The rib 63, which is formed as an integral part of the horizontal base plate 51, is located between a straight row of the tappet guide 54 associated with the intake camshaft 15 and a straight row of spark plug guide bores 58 and extends in parallel to the intake camshaft 15 in a direction from the front to the back of the engine 1. An oil gallery 65 is formed in the rib 63. Similarly, the rib 63, which is formed as an integral part of the horizontal base plate 51, is located between a straight row of the tappet guide 54 associated with the exhaust camshaft 16 and the straight row of spark plug guide bores 58 and extends in parallel to the exhaust camshaft 16 in a direction from the front to the back of the engine 1. An oil gallery 66 is formed in the rib 64.

Figure 3:
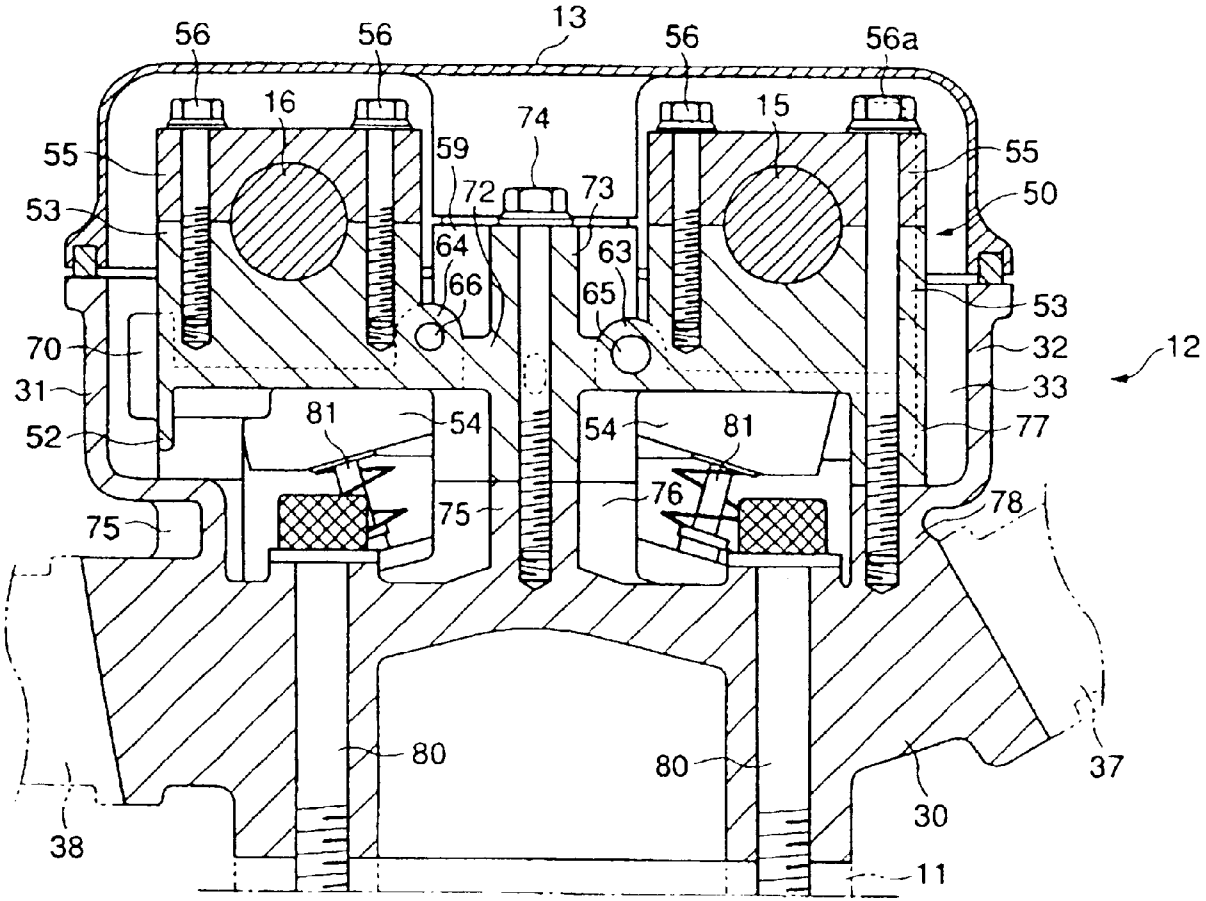
FIG. 3 is a cross-sectional view of the engine taken along line III—III of FIG. 2.
Figure 4:
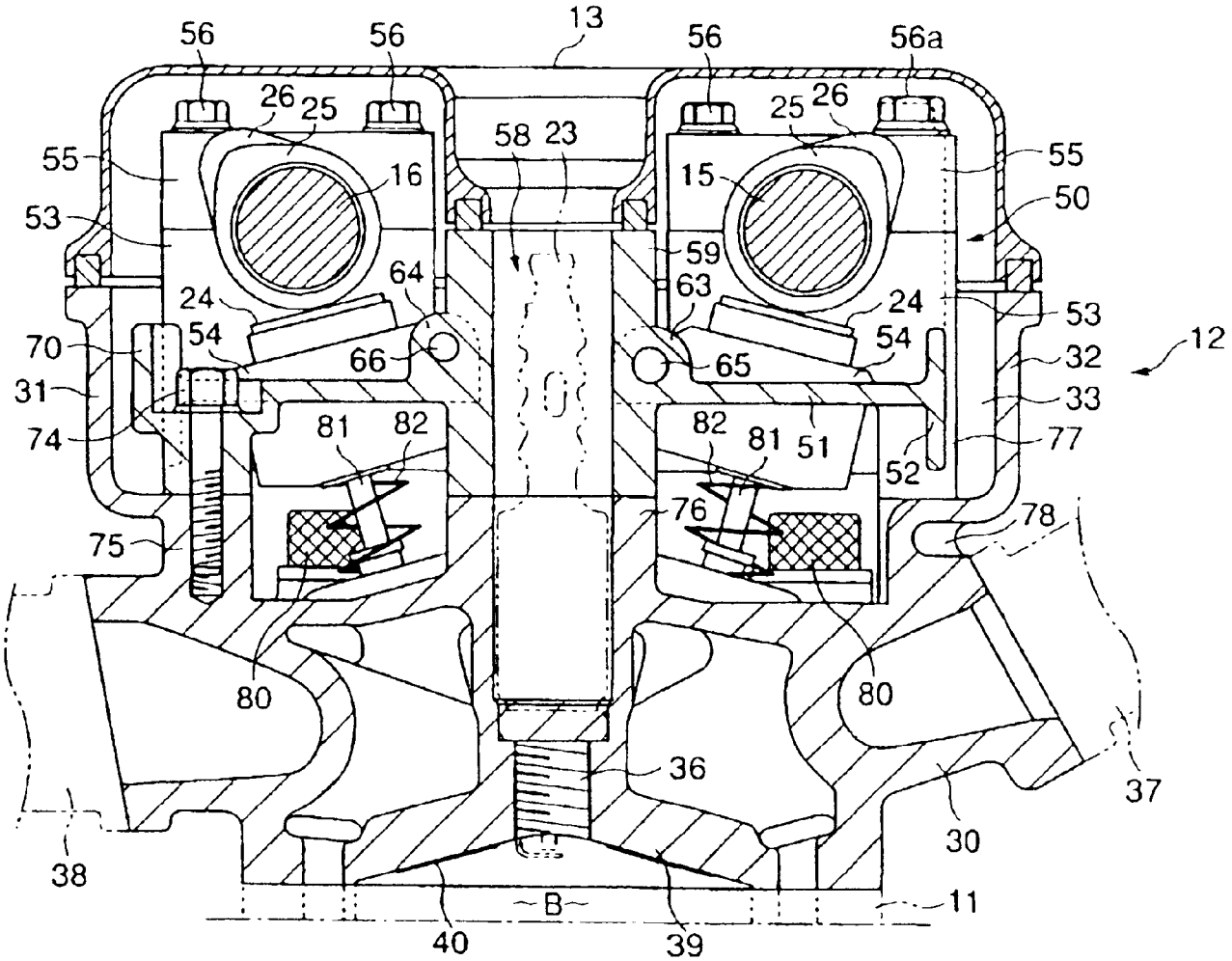
FIG. 4 is a cross-sectional view of the engine taken along line IV—IV of FIG. 2.
Figure 5:
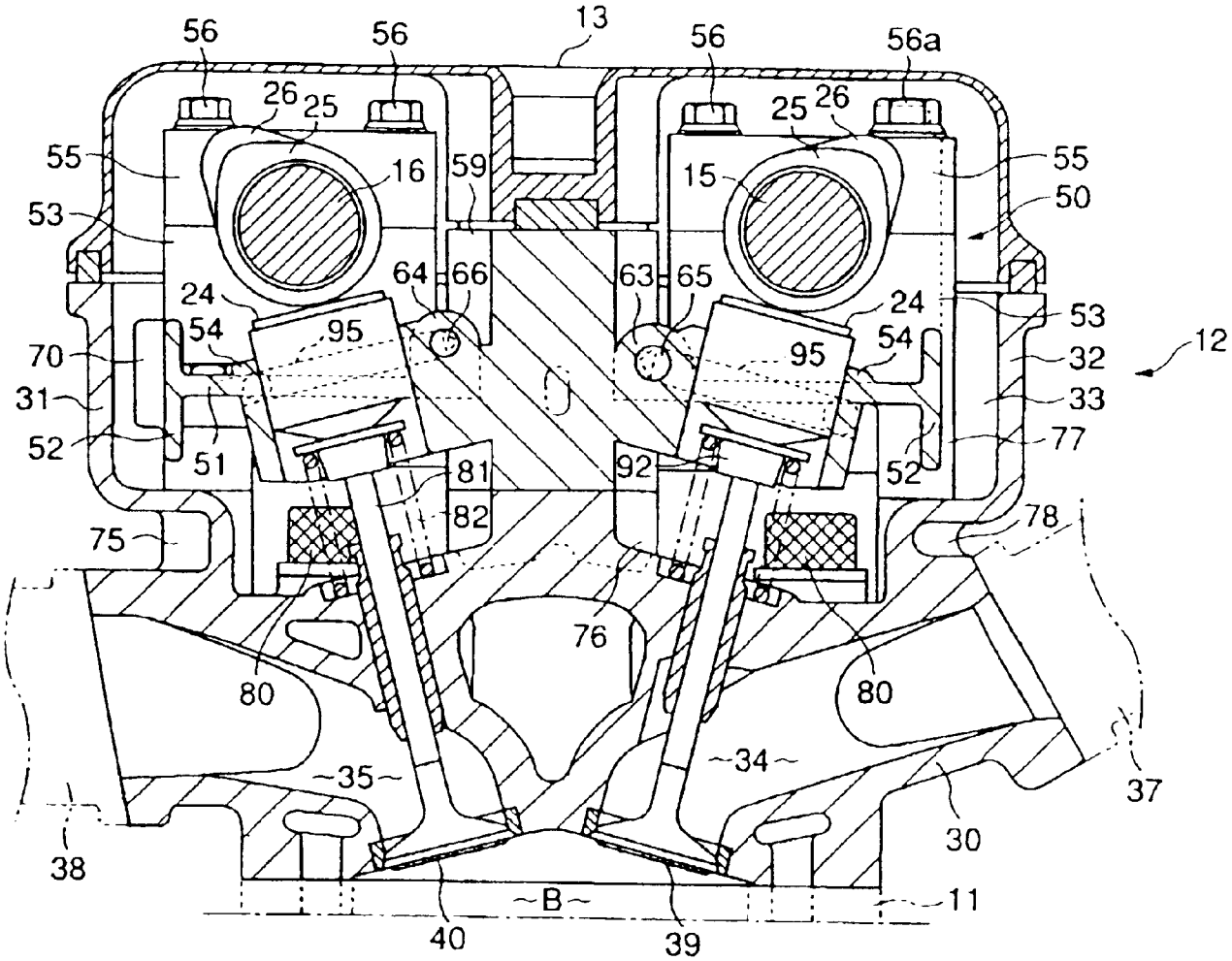
FIG. 5 is a cross-sectional view of the engine taken along line V—V of FIG. 2.
Figure 6:
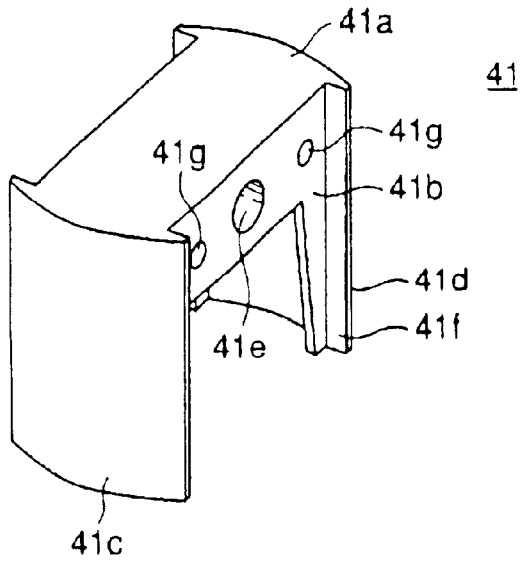
FIG. 6 is a perspective view of a center tappet.
Figure 7:
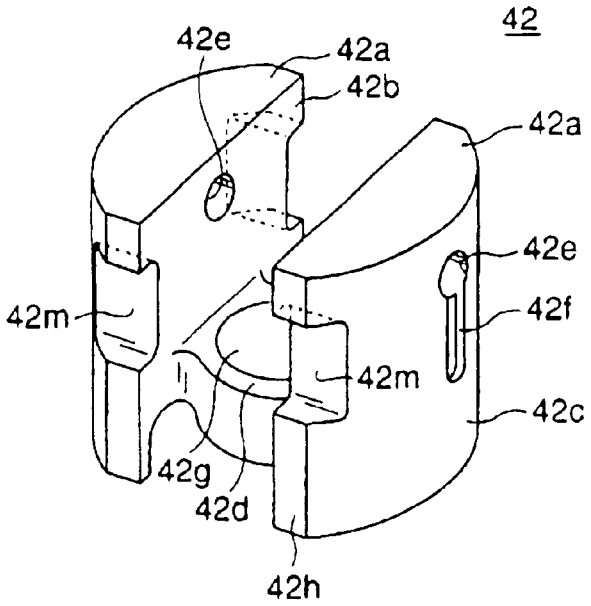
FIG. 7 is a perspective view of a side tappet.
Figure 8:
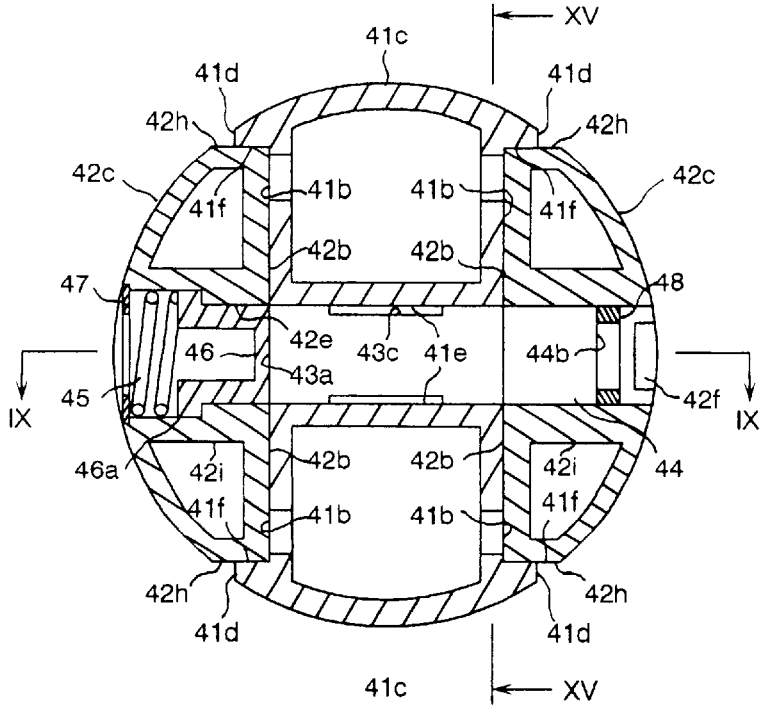
FIG. 8 is a plane cross-sectional view of a tappet assembly.

As clearly shown in FIG. 3, the horizontal base plate 51 is formed with a plurality of circular-shaped recesses 70 at the front side thereof and a plurality of circular-shaped projections 71 (see FIG. 2) at the rear side thereof. Further, the horizontal base plate 51 has a cylindrical column 72 with a through bore 73 formed at the center thereof. The cylinder head 12 has cylindrical columns 75 correspondingly in position to the circular-shaped recesses 70, circular-shaped projections 71 and bridge 73. In securing the cam carrier 50 to the cylinder head 12, the cam carrier 50 is placed on the cylinder head by bringing these circular-shaped recesses 70, circular-shaped projections 71 and bridge 73 into contact with the columns 75, respectively and then fixedly secured to the cylinder head 12 by fastening bolts 74 into the columns 75. The cylinder head 12 at the base portion 30 has further cylindrical columns 76 correspondingly in position to the columns 59 and 62 of the cam carrier 50. These cylindrical columns 76 are such that when the cam carrier 50 is secured to the cylinder head 12, the columns 76 are abutted against by the columns 59 and 62 of the cam carrier 50, this is advantageous to stably fix the cam carrier 50 to the cylinder head 12.

Some of the fastening bolts 56, namely the fastening bolts 56*a* that are used to fixedly secure the bearing upper block 55 to the bearing lower block 53 for supporting the intake camshaft 15, are sufficiently long in length differently from the remaining fastening bolts 56 so as to extend passing through both bearing lower block 53 and horizontal base plate 51, thereby fixedly securing the cam carrier 50 to the cylinder head 12 while fixedly securing the bearing upper block 55 to the both bearing lower block 53. In this instance, the cam carrier 50 has cylindrical columns 77 extending downward from the horizontal base plate 51 at locations corresponding to these fastening bolts 56*a*, and the cylinder head 12 is formed with cylindrical columns 78 extending upward from the cylinder head base portion 30 as counterparts of the cylindrical columns 77. When the cam carrier 50 is secured to the cylinder head 12, the cylindrical columns 78 of the cylinder head 12 are abutted against by the cylindrical columns 77 of the cam carrier 50, this is advantageous to stably fix the cam carrier 50 to the cylinder head 12.

As clearly shown in FIG. 3, the cylinder head 12 is fixedly secured to the cylinder block 11 by fastening bolts 80. The fastening bolts 80 are located such that the fastening bolts 80 are on each of the opposite sides of the straight row of the cylinder A as viewed in the longitudinal direction of the vehicle body and that there is one fastening bolt 80 per camshaft behind each cylinder A as viewed in the transverse direction of the vehicle body. This arrangement of fastening bolts 80 causes the fastening bolts 80 receive explosion force generated in the respective cylinders 1 equally.

As described above, in the structure associated with camshaft drive mechanism, the cam carrier 50, that is provided separately from the cylinder head 12, has the bearing lower blocks 53 forming part of the journal bearings 57 and the tappet guides 54. This structure enables the bearing lower blocks 53 of the journal bearings 57 and the tappet guides 54 to be assembled to the cylinder head 12 all at once by fixing the cam carrier 50 to the cylinder head 12 only, so as to prevent aggravation of assembling performance and serviceability of the engine 1 that is caused due to possible mechanical interference between the fastening bolts 80 and the camshafts 15 and 16. In addition, this structure provides significant improvement of layout and, as a result of which, the cylinder head 12 is improved in assembling performance and enabled to be compact. The cam carrier 50 is constructed by means of mutual combinations of various parts stretching or extending in different directions such as the horizontal base plate 51, the peripheral shroud 52, the bearing lower block 53, the tappet guides 54 and the like and, in consequence, these parts are complementary to each other. As a result, the cam carrier 50 is given a high stiffness and leads to stable support of the camshafts 15 and 16, the tappet assemblies 24 and the hydraulic oil supply control valve 60. Further, because the cam carrier 50 is provided separately from the cylinder head 12, there occurs no possible mechanical interference between the fastening bolts 80 and the bearings 57 comprising the upper and lower bearing blocks 53 and 55, so that the layout of bolts 80 causes no constraints on the degree of freedom in arranging the bearings 57. This permits both the bearing 57 and fastening bolt 80 to clash in position with each other such that they are located in an intermediate position between two adjacent cylinders 2 on one of the opposite sides of a straight row of the cylinder A as viewed in the lengthwise direction of the vehicle body.

FIGS. 6 through 9 shows the tappet assembly 24 in detail. It is to be noted that while the same tapped assembly 24 is installed to each of valve trains for the intake valve 39 and the exhaust valve 40, respectively, in the embodiment shown in FIG. 10, it may be installed either one of the valve trains.

Figure 10:
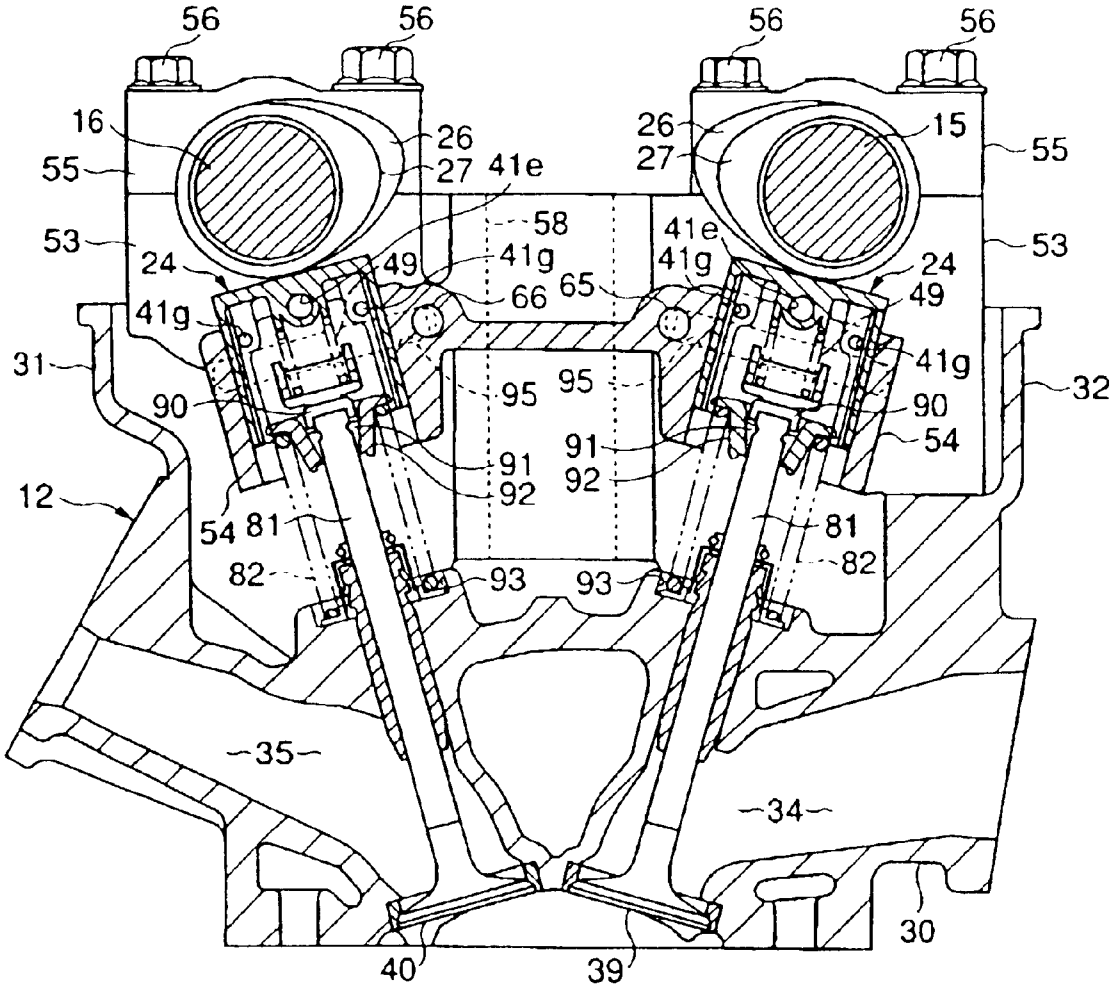
FIG. 10 is a cross-sectional view of an essential part of a cylinder head with the tappet assembly installed thereto.

As shown in FIG. 10, the tappet assembly 24 is almost touched by the upper end of valve stem 81 through a shim 90. The tapped assembly 24 has a valve spring retainer 92. On the other hand, the cylinder head 12 has an annular recess 93 per valve. A valve spring 82 is mounted on the valve stem 81 between the valve spring retainer 92 and the annular recess 93 of the cylinder head 12 so as to force the tappet assembly 24 to the cam lobe of the cams of the camshaft 15, 16. A branch oil channel 95 branches off from the oil gallery 65 at a right angle. Similarly, a branch oil channel 95 branches off from the oil gallery 66 at a right angle. The branch oil channel 95 is made by drilling a channel in the cylinder head 12 from the front side thereof or the rear side thereof so as to reach the oil gallery 65 or 66. The oil channel at the front side of the cylinder head 12 or at the rear side of the cylinder head 12 is stopped up by a ball 95*a* (see FIG. 11). The branch oil channel 95 is formed so as to partly overlap the outer peripheries of each adjacent tappet assemblies 24 (see FIG. 11). Oil flows in the oil gallery 65, 66, enters the branch oil channel 95, and then enters in the interior of the bore as the tappet guide 54.

Figure 11:
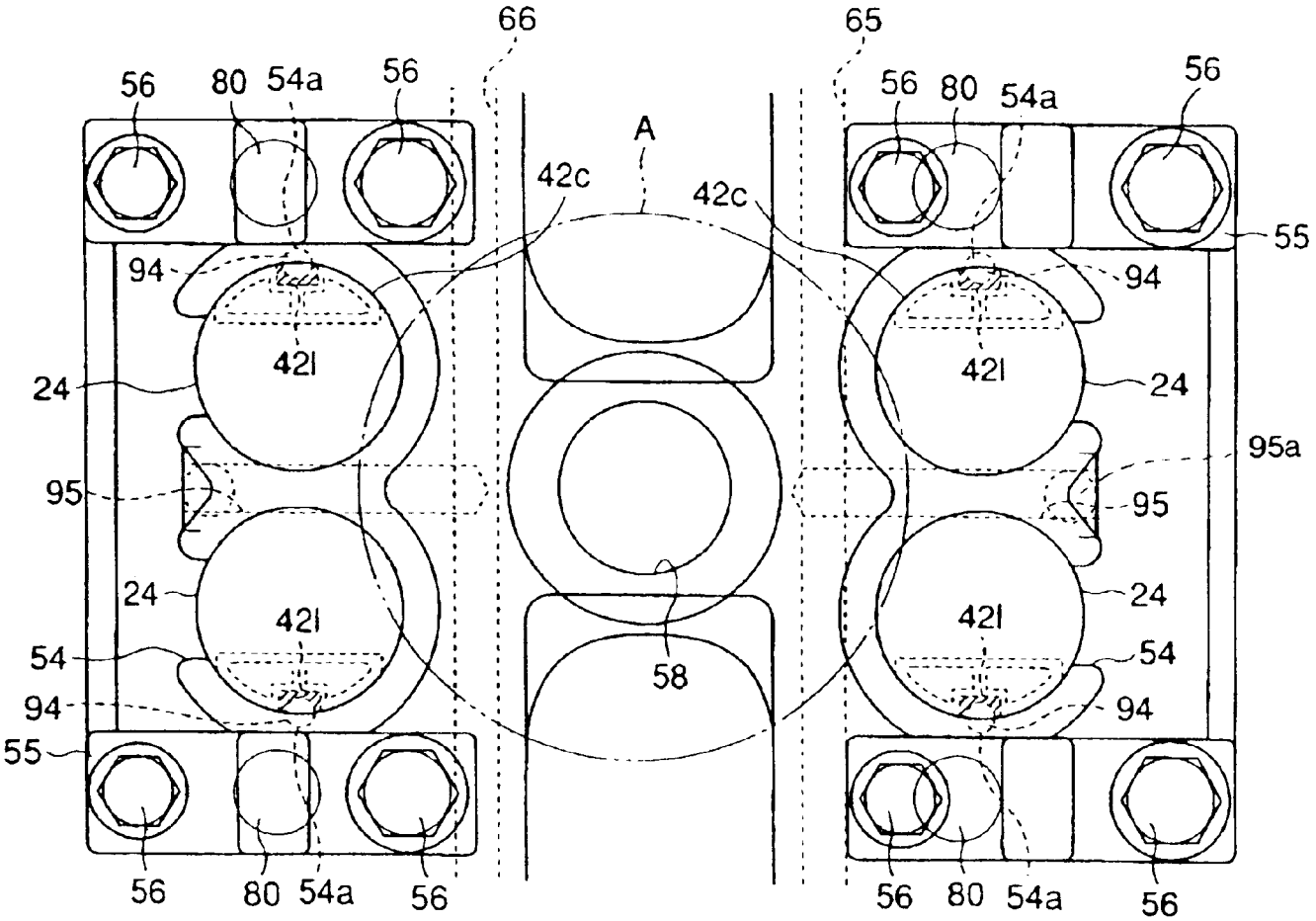
FIG. 11 is a plan view partly showing the cylinder head.

As shown in FIG. 11, the tappet guide 54 is formed with a recess 54*a* in the interior wall thereof. As will be described, the side tappet 24 has a ball retainer 421 fixedly fitted in a side surface 42*c* on a side remote from the oil gallery 65, 66 with respect to the center tappet 41. The ball retainer 421 is located so as to face the recess 54*a* of the tappet guide 54. A ball 94 is in the ball retainer 421. W hen installing the tappet assembly 24 into the tappet guide 54, the ball 94 is interposed between the ball retainer 421 of the tappet assembly 24 and the recess 54*a* of the tappet guide 54. The ball 94 prevents the tappet assembly 24 from turning in the tappet guide 54 during insertion of the tappet assembly 24 into the tappet guide 54.

The tappet assembly 24 comprises a side tappet 42 attached to the valve stem 81 of the valve 39 40 and the center tappet 41. The side tappet 42 the side tappet 42 has two tappet heads 42*a* separated apart from each other. The center tappet 41 is received for slide movement between the tappet heads 42*a* of the side tappet 42. As describe later, the tappet assembly 24 has a coupling mechanism between these center tappet 41 and side tappet 42 which mechanically couples them together so as to allow the center tappet 41 to slide up and down relative to the side tappet 42. The side tappet 42 at the tappet heads 42*a* rides on the lobes of the low lift side cams 25 and 27 so as to slide up and down, thereby opening and closing the valve 39, 40 when the camshaft 15, 16 turns. The center tappet 41 at a tappet head 41*a* rides on the lobe of the high lift center cam 26. The center tappet 41 is slid up and down relatively to the side tappet 42 while it is mechanically uncoupled from the side tappet 42. Accordingly, the center tappet 42 is not contributory to opening and closing the valve 39, 40 even though the camshaft 15, 16 turns. On the other hand, while the center tappet 41 is mechanically coupled to the side tappet 42, the center tappet 41 is slid up and down integrally with the side tappet 42 by the high lift center cam 26. The low lift side cam 25, 27 is used as a slow speed cam, and the high lift center cam 27 is used as a fast speed cam.

More specifically describing, the tappet assembly 24, having a generally cylindrical configuration, is made up of two mating parts, namely a center tappet 41 and a side tappet 42. The tappet assembly 24 is divided into three tappet head sections in an axial direction of the camshaft 15, 16, namely the center tappet head 41*a* and the side tappet heads 42*a* on opposite side of the center tappet had 41*a*. Each tappet head 41*a*, 42*a* has a length greater in the direction perpendicular to the axis of rotation of the cam 25, 26, 27 than a width in the direction of the axis of rotation of the cam 25, 26, 27. The center tappet 41, that has a generally inverted U-shaped configuration, is formed with flat end walls 41*b* at opposite sides thereof in the direction of the axis of rotation of the cam 25, 26, 27. Each end wall 41*b* extends perpendicularly to a flat top wall of the tappet head 41*a* which is perpendicular to the axis of the valve stem 81. The center tappet 41 is further formed with circular-arcuate side walls 41*c* at opposite sides thereof in the direction perpendicular to the axis of rotation of the cam 25, 26, 27. In addition, the center tappet 42 is formed with a vertical flat side shroud 41*d* extending as an extension of the side wall 41*c*. These circular-aruate side wall 41*c* and vertical side shrouds 41*d* form parts of an outer shell of the tappet assembly 24. The vertical side shroud 41*d* forms a vertical flat side surface facing a vertical side wall 42*h* formed on the side tappet 42 (which will be described later). The center tappet 41 is further formed with a guide bore 41*e* passing through the end walls 41*b*. This guide bore 41*e* extends at the center of the end walls 41*b* in the direction parallel to the axis of rotation of the cams 39, 40.

Figure 9:
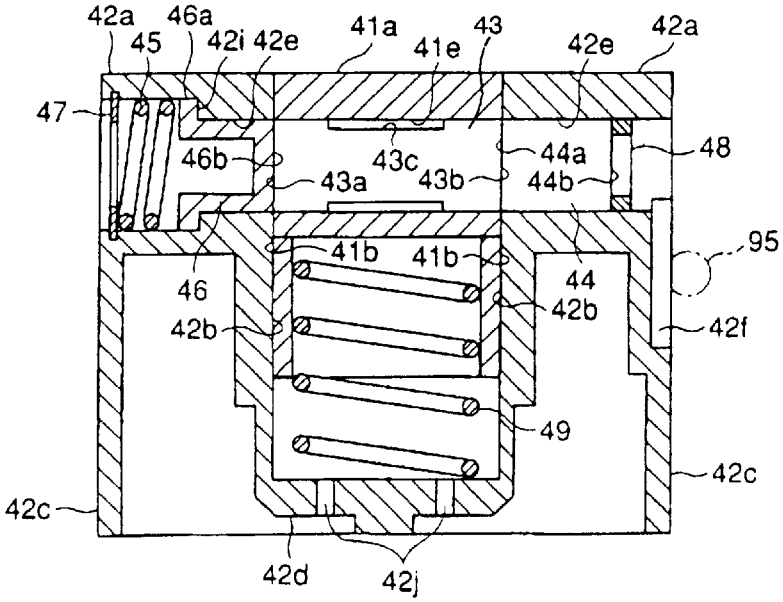
FIG. 9 is cross-sectional view of the tappet assembly.

The side tappet 42 has a generally U-shaped configuration complementary to the inverted U-shaped configuration of the center tappet 41. The center tappet 41 and the side tappet 42 form a complete cylindrical configuration when they are assembled to each other as the tappet assembly 24. The side tappet 42 is formed with flat inner end walls 42*b* separated from each other and circular-arcuate outer end walls 42*c* at opposite sides thereof in the direction of the axis of rotation of the cam, 25, 26, 27. The opposite circular-arcuate end walls 42*c* of the side tappet 41 and the opposite circular-arcuate side walls 41*c* form a generally cylindrical configuration of an outer shell of the tappet assembly. The inner end walls 42*b* are parallel to each other and extend perpendicularly to flat top walls of the tappet head 42*a* which are perpendicular to the axis of the valve stem 81. The distance between the inner end walls 42*b* is such that the center tappet 41 is received for slide movement between the inner end walls 42*b*. The side tappet 42 is further formed with vertical flat side walls 42*h* as guide surfaces at opposite sides thereof in the direction perpendicular to the axial direction of the cam 25, 26, 27 so that each side wall 42*h* connects each adjacent inner and outer end walls 42*b* and 42*c*. The circular-arcuate end walls 42*c* form parts of the outer shell of the tappet assembly 24 and cooperate with the circular-arcuate end walls 41*c* of the center tappet 41 so as to complete the generally cylindrically configuration of the outer shell of the tappet assembly 24. The flat side walls 42*h* mate with the flat side surfaces 41*f* of the vertical flat side shrouds 41*d*, respectively, when the center tappet 41 is installed to the side tappet 42. These shroud 41*d* formed with the guide surface 41*f* an the side walls 42*h* form guide means for guiding reciprocal slide movement of the center tappet 41 relative to the side tappet 42. The side tappet 42 further has a bridge 42*d* interconnecting lower portions of the flat inner end walls 42*b*. The bridge 42*d* is formed with a spring receiving recess 42*g* in which a tappet spring 49 is received. As shown in FIG. 9, there are oil spill ports 42*j* formed at the bottom of the spring receiving bore 42*g* so as to drain away oil trapped at the bottom of the inner end walls 42*b*.

The side tappet 42 is further formed with first and second guide bores 42*e*, each of which passes through the inner and outer end walls 42*b* and 42*c*. These guide bores 42*e* extend at the center of the inner and outer end walls 42*b* and 42*c* in the direction parallel to the axis of rotation of the cams 39, 40 so as to be brought into alignment with the guide bore 41*e* when the center tappet 41 is installed to the side tappet 42. There is an oil channel 42*f* extending in parallel to the axis of the valve stem 81 from the first guide bore 42*e* in the outer end wall 41*b* of the side tappet 42.

When the center tappet 41 is installed to the side tappet 42, the vertical side shrouds 41*d* of the center tappet 41 are brought into slide contact with the vertical side walls 42*h* of the side tappet 42, respectively. Accordingly, during relative movement of the center tappet 41, the center tapped 41 is guided through slide contact between the vertical side shrouds 41*d* and the vertical side walls 42*h*. The tappet assembly 24 thus structured disperses and transmits a force that is exerted on the side tappet 41 by the side cams 25 and 26 to the center tappet 41 through the slide contact between the vertical side shrouds 41*d* and the vertical side walls 42*h* while the valve is driven by side cams 25 and 25 through the side tappets 42 uncoupled from the center tappet 41. As a result, not only the side tappet 42 but also the center tappet 41 are pressed against the tappet guide 54 at their opposite circular-arcuate walls 41*c* and 42*c*. This leads to a decrease in interface resistance between the center and side tappets 41 and 42 and the tappet guide 54, which provides improvement of wear-restant properties of the center and side tappets 41 and 42 and the tappet guide 54.

The center tappet 41 and the side tappet 42 mate with each other to form a generally cylindrically-shaped tappet assembly 24 when they are installed to each other. When the center tappet 41 is installed in the side tappet 42 the tappet heads 41*a* and 42*a* of the center tappet 41 and the side tappet 42 are brought even with one another, and the guide bores 41*e* and 42*e* of the center tappet 41 and the side tappet 42 are brought into alignment with one another. This state is such that the cams 25–27 at their base ride on the tappet heads 41*a* and 42*a*, respectively.

There is a lock mechanism in the tappet assembly 24 which cooperates with the guide bore 41*e* of the center tappet 41 and the guide bores 42*e* of the side tappet 42 so as to mechanically couple the center and side tappets 41 and 42. Specifically, the lock mechanism comprises a locking/unlocking pin 43, a plunger 44 and a cup-shaped receiver 46 having a flange 46*a*. The locking/unlocking pin 43 is received for slide movement in the guide bore 41*e* of the center tappet 41. The locking/unlocking pin 43 has the same axial length as the guide bore 41*e* of the center tappet 41 and is formed with circumferential recess 43*c* so as to reduce a contact area with the guide bore 41*e*. The plunger 44 is received for slide movement in the first guide bore 42*e* of the side tappet 42. The receiver 46 is received for slide movement in the second guide bore 42*e* of the side tappet 42 and forced against the locking/unlocking pin 44 by a receiver spring 45 received in the second guide bore 42*e* of the side tappet 42. As shown in FIG. 9 in detail, the plunger 44 is shorter in the axial direction of the camshaft 15, 16 than the first guide bore 42*e* and stopped by an annular stopper ring 48 so as to provide an oil chamber in the first guide bore 42*e* at the outer end of the plunger 44. The plunger 44 is such that, when the plunger 44 is stopped by the annular stopper ring 48, the plunger 44 places the locking/unlocking pin 43 in a neutral position where the opposite end surfaces 43*a* and 43*b* of the locking/unlocking pin 43 are even with opposite end walls 41*b* of the center tappet 41, respectively. Pressurized oil is supplied to the plunger 4 in the guide bore 42*e* through the oil channel 42*f* of the side tappet 42 extending from the first guide bore 42*e* of the side tappet 42. The oil channel 42*f* is sufficiently long in the vertical direction so that the first guide bore 42*e* always remains in communication with the branch oil channel 95 while the side tappet 42 moves up and down.

The plunger 44 is operated by hydraulic oil that is generated by the hydraulic oil supply control valve 60 (see FIG. 2). The hydraulic oil is supplied into the oil chamber in the first guide bore 42*e* through the oil channel 42*f* through the branch oil channel 95 branching off from the oil gallery 65, 66 and then acts on the outer end of the plunger 44 so as to always force the plunger 44 against the locking/unlocking pin 43 in a direction opposite to the direction in which the plunger 44 is forced by the spring loaded receiver 46. The receiver spring 45 is retained in the second guide bore 42*e* by an annular retainer ring 47. The second guide bore 42*e* of the side tappet 42 is formed with a shoulder 42*i* so that the flange 46*a* of the receiver 46 abuts against the shoulder 42*i* for restriction of axial movement of the receiver 46. The receiver 46 is such that, when the flange 46*a* of the receiver 46 abuts against the shoulder 42*i*, the receiver 46 places the locking/unlocking pin 43 in the neutral position where the opposite end surfaces 43*a* and 43*b* of the locking/unlocking pin 43 are even with opposite end walls 41*b* of the center tappet 41, respectively.

When applying controlled hydraulic oil in the oil chamber in the first guide bore 42*e* of the side tappet 42 to the plunger 44, the plunger 44 is forced to enter the guide bore 41*e* of the center tappet 41 pushing the locking/unlocking pin 43 against the receiver spring 45 and, in consequence, the locking/unlocking pin 43 is forced to enter the second guide bore 42*e* of the side tappet 42 pushing the receiver 46 against the receiver spring 45. As a result, the center tappet 41 and the side tappet 42 are mechanically coupled together by the plunger 44 and the locking/unlocking pin 43, respectively. On the other hand, when removing the control hydraulic oil in the oil chamber in the first guide bore 42*e* of the side tappet 42, the receiver 46 is pushed by the receiver spring 45 so as to force the locking/unlocking pin 43 and the plunger 44 to return into their neutral positions, respectively. As a result, the center tappet 41 is mechanically uncoupled from the side tappet 42.

The branch oil channel 95 is in communication with a lower portion of the oil channel 42*f* extending from the first guide bore 42*e* of the side tapped 42. This oil channel 95 is formed in the base portion 30 of the cylinder head 12 by boring or drilling the front side and rear end shrouds 31 and 32 aiming at the oil gallery 65, 66 after forming the cylinder head 12 such that it partly overlaps the inner wall of the recess 54*a* of the adjacent tappet guide 54 and is brought into communication with the oil channel 42*f* when the side tappet 24 is assembled. This avoids drilling the branch oil channel per the tappet guide, which leads to a reduction in man-hour for forming the branch oil channel.

Figure 12:
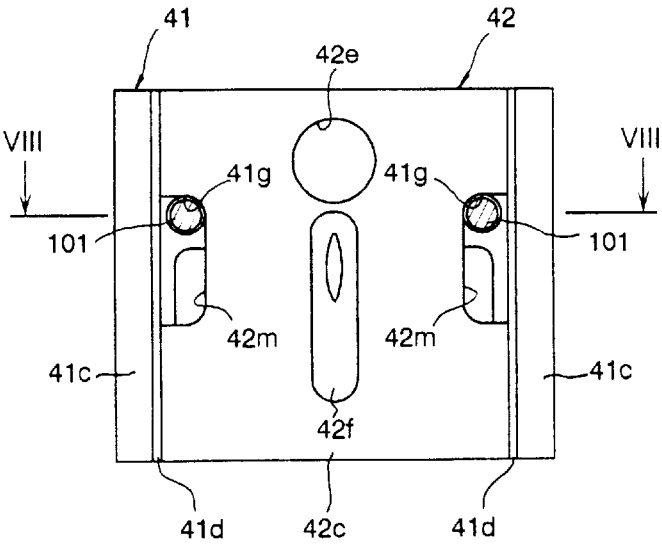
FIG. 12 is an end view of the tappet assembly.
Figure 13:
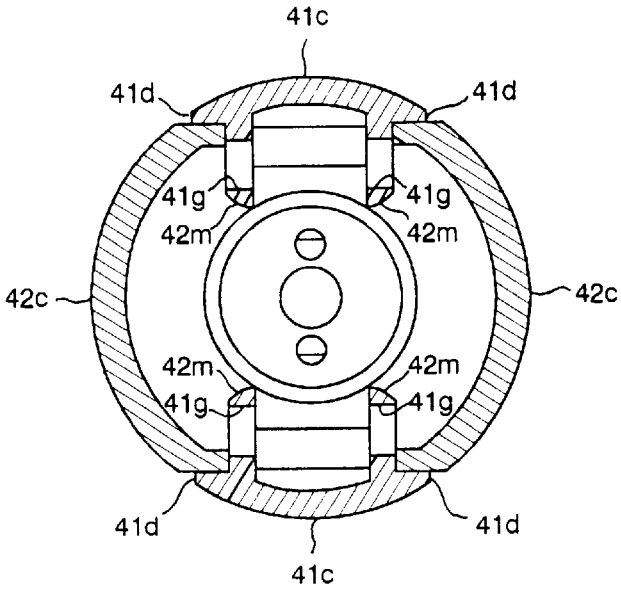
FIG. 13 is a plane cross-sectional view of the tappet assembly taken along line XIII—XIII of FIG. 12.
Figure 14:
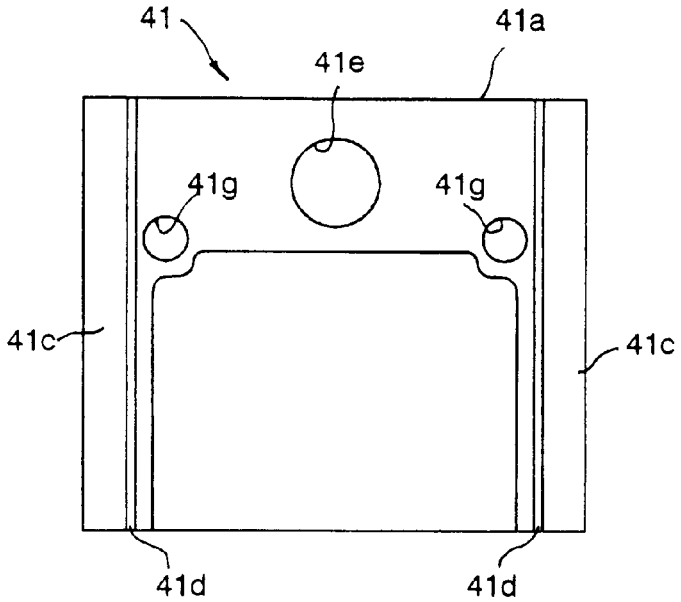
FIG. 14 is an end view of the center tappet.
Figure 15:
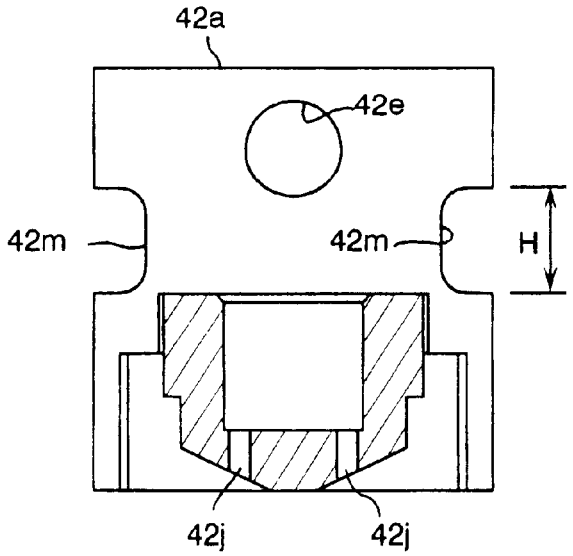
FIG. 15 is a cross-sectional view of the side tappet taken along line XV—XV of FIG. 8.

FIGS. 12 to 15 shows various aspects of the tappet assembly 24. FIG. 12 shows one end of the tappet assembly 24. FIG. 13 shows a cross-section of the tappet assembly 24 taken along line XIII—XIII of FIG. 12. FIG. 14 shows one end of the center tappet 41. FIG. 15 shows a vertical-section of the tappet assembly 24 taken along line XV—XV of FIG. 8.

As shown in FIGS. 6, 7, 10 and 12 to 15, the center tappet 41 is formed with retaining pin supporting bores 41*g* passing through the center tappet 41 for receiving retaining pins 101, respectively. Specifically, two retaining pin supporting bores 41*g* are arranged in alignment with each other in the axial direction of the camshaft 15, 16 on each side of the guide bore 41*e*. These retaining pin supporting bores 41*g* are arranged symmetrical with the vertical center axis of the center tappet 41. The side walls 42*h* of the side tappet 42 at opposite sides are formed with limiting recesses 42*m* facing the retaining pin supporting bores 41*g*, respectively, and extending vertically. Each limiting recess 42*m* is located such that the retaining pin supporting bore 41*g* exposes the exterior of the tappet assembly 24 through the limiting recess 42*m* when the center tappet 41 is installed to the side tappet 42. This enables insertion of the retaining pins 101 into the retaining pin supporting bores 41*g* after installation of the center tappet 41 to the side tappet 42. Since the structure of the tappet assembly 24 is such that the center tappet 41 is forced by the tappet spring 49 so as to always abut against the high lift center cam 26, the locking/unlocking pin 43 possibly comes off from the guide bore 41*e* due to upward movement of the center tappet 42 that is caused by the tappet spring 49 in the course of assembling the center tappet 41 to the side tappet 42. The structure of the tappet assembly 24 prevents the locking/unlocking pin 43 from coming off from the guide bore 41*e* by inserting the retaining pins 101 into the retaining pin supporting bores 41*g* and engaging opposite ends of the retaining pins 101 by upper ends of the limiting recesses 42*m*. Specifically, the limiting recess 42*m* is such as to bring the retaining pin 101 into engagement with the upper end of the limiting recess 42*m* when the tappet head 41*a* of the center tappet 41 is substantially even with the tappet heads 42*a* of the side tappet 42 and to have a vertical length H greater than a distance by which the center tappet 41 and the side tappet 42 are allowed to move relatively to each other. Otherwise, these retaining pin support bore 41*g* and limiting recesses 42*m* may be replaced with each other.

Figure 16:
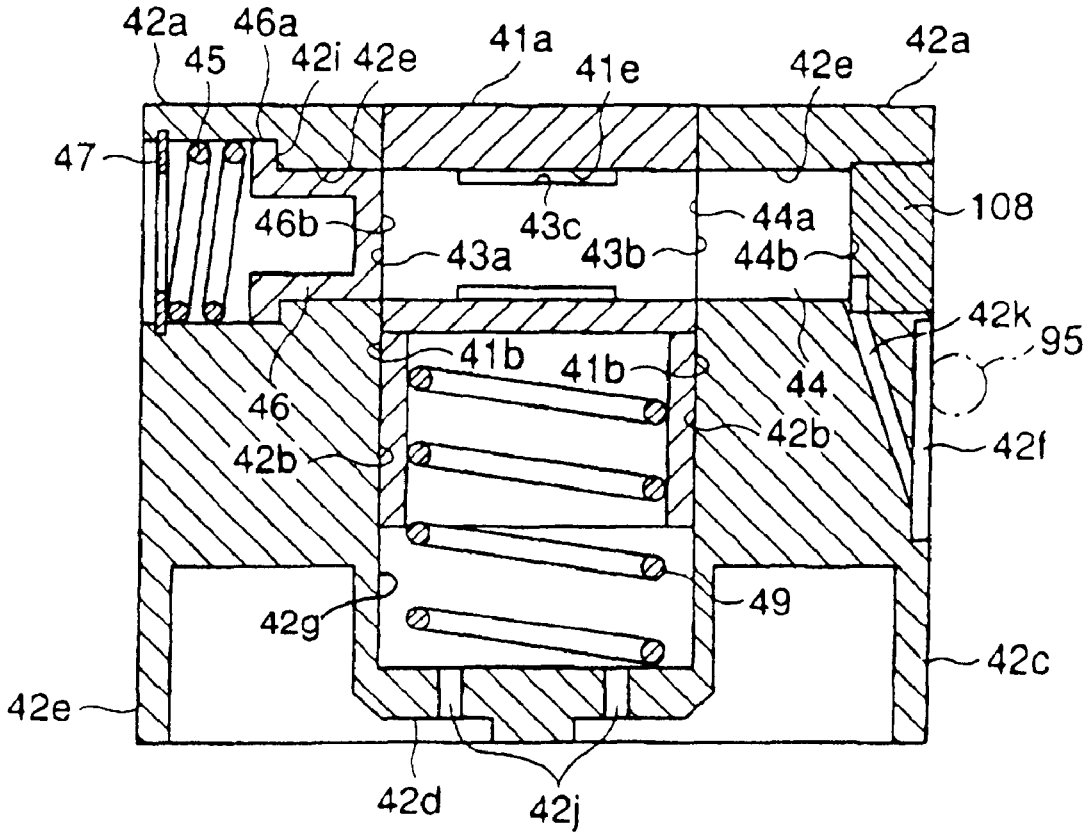
FIG. 16 is a plane cross-sectional view of an variant of the tappet assembly shown in FIG. 8.

FIG. 16 shows a tappet assembly 24 in accordance with another embodiment of the present invention. The tappet assembly 24 is different from that of the previous embodiment described above in that a guide bore 42*e* of a side tappet 42 in which a plunger 44 is received is closed by a stopper block 108 which is provided in place of the annular stopper ring 48 of the previous embodiment so as a stopper member for limiting axial slide movement of the plunger 44 and that the guide bore 42*e* is in communication with an oil channel 42*f* formed in an outer end wall 41*b* of the side tappet 42 through a connecting oil channel 42*k*.

In operation of the valve drive mechanism equipped with the tappet assembly 24, when it is intended to drive the valve 39, 40 for low lift valve operation for low speed operation of the engine 1, the hydraulic oil supply control valve 60 is operated to remove hydraulic oil from the oil chamber of the first guide bore 42*e* of the side tappet 42. The locking/unlocking pin 43, and hence the plunger 44, is moved in the axial direction by the spring loaded receiver 46 until the plunger 44 is stopped by the annular stopper ring 48 or the stopper block 108. When the plunger 44 is brought into abutment against the annular stopper ring 48 or the stopper block 108, the locking/unlocking pin 43 comes out of the second guide bore 42*e* of the side tappet 42 and is fully accepted in the first guide bore 41*e* of the side tappet 42, so that the center tappet 41 is mechanically uncoupled from the side tappet 42 and, in consequence, permitted to move relatively to the side tappet 42. Therefore, when the camshaft 15, 16 rotates, although the cams 25–27 cause reciprocating movement of the center and side tappets 41 and 42, the center tappet 41 reciprocally moves up and down relatively to the side tappet 42, so that rotation of the camshaft 15, 16 is not transmitted to the valve 39, 40 through the high lift center cam 26. As a result, rotation of the camshaft 15, 16 is transmitted to the valve 39, 40 by both the low lift side cams 25 and 27.

On the other hand, when it is intended to drive the valve 39, 40 for high lift valve operation for high speed operation of the engine 1, the hydraulic oil supply control valve 60 is operated to supply hydraulic oil into the oil chamber of the first guide bore 42*e* of the side tappet 42 so as to force the plunger 44, and hence the locking/unlocking pin 43 against the return spring 45. As a result, the plunger 44 partly enters the guide bore 41*e* of the center tappet 41, and hence, the locking/unlocking pin 43 partly enters the second guide bore 42*e* of the side tappet 42, so that the center tappet 41 is mechanically coupled to the side tappet 42 together. Therefore, when the camshaft 15, 16 rotates, rotation of the camshaft 15, 16 is transmitted to the valve 39, 40 by the high lift center cam 26 only through the center tappet 41 mechanically coupled to the side tappet 42.

Coupling the center tappet 41 to the side tappet 42 or uncoupling the center tappet 41 from the side tappet 42 is performed while the center and side tappets 41 and 42 at their tappet heads 41*a* and 42*a* ride on the base of the lobes of the center and side cams 25, 26 and 27.

According to the valve drive mechanism equipped with the tappet assembly described above, since the center tappet 41 can cause large reciprocating movement relative to the side tappet 42, a valve lift difference between low lift and high lift operation of the valve 39, 40.

In the case where the tappet assembly 24 is used in order to cause a swirl of intake air in the combustion chamber of the engine 1, the valve drive mechanism employs low lift side cams 25 and 27 having substantially circular profiles for either one of two intake valves for each combustion chamber so that the one intake valve is not lifted during high speed operation of the engine 1. In this case, it is necessary for the side cams 25 and 27 to have an effective valve lift of approximately 2 mm in order to force out fuel collected in the intake port and to intpinuce it into the combustion chamber.

The tappet assembly can be incorporated in a valve drive mechanism in which two intake valves or two exhaust valves per cylinder are driven by cams having cam profiles that are different and variable.

It is to be understood that although the present invention has been described in detail with regard to preferred embodiments thereof, various other embodiments and variants may occur to those skilled in the art, which are within the scope and spirit of the invention, and such embodiments and variants are intended to be covered by the following claims.

What is claimed is:

1. A valve drive mechanism having one center cam (26) having a center cam lobe and a pair of side cams (25, 27) having side cam lobes different from said center cam lobe for one valve (39, 40), said side cams (25, 27) being arranged on a camshaft (15, 16) on opposite sides of said center cam (26) in an axial direction of said camshaft (15, 16), a generally cylindrically shaped tappet assembly (24), which is movable in a direction of valve lift, comprising two mating parts, and locking/unlocking means **(41*e*, 42*e*, 43–46) for mechanically coupling and uncoupling said two mating parts together so as to selectively transmit rotation of said center cam (26) and said side cams (25, 27) as reciprocating movement to said valve (39, 40)**, said valve drive mechanism comprising:

a center tappet (41) forming one of said two mating parts (41, 42) and driven by said center cam (26); said center tappet (41) being formed with opposite circular-arcuate vertical side walls **(41*c*) in a rotational direction of said camshaft (15, 16)**;

a side tappet (42) forming another one of said two mating parts and driven by said side cams (25, 27), said side tappet (42) being divided into two side tappet parts in said axial direction of said camshaft (15, 16) between which said center tappet (41) is received for slide movement relative to said side tappet (42) in said direction of valve lift, said side tappet (42) at said side tappet parts being formed with opposite circular-arcuate vertical end walls **(42*c*), respectively, such that said circular-arcuate vertical side walls (41*c*) of said center tappet (41) and said circular-arcuate vertical end walls (42*c*) of said side tappet (42) form a generally cylindrical configuration of said tappet assembly (24); and guide means for guiding said slide movement of said center tappet (41) relative to said side tappet (42), said guide means comprising a vertical flat side wall (42*h*) extending continuously from each of opposite sides of each said circular-arcuate end wall (42*c*) of said side tappet (42) in said rotational direction of said camshaft (15, 16) and a vertical shroud (41*d*) extending continuously from each of opposite ends of each said circular-arcuate side wall (41*c*) of said center tappet (41) in said axial direction of said camshaft (15, 16) and forming thereon a vertical flat side surface (41*f*), said vertical shroud (41*d*) at said vertical flat side surface (41*f*) being slidable on said vertical flat side wall (42*h*) so as thereby to guide said slide movement of said center tappet (41) relative to said side tappet (42)**.

2. A valve drive mechanism as defined in claim 1, wherein said center cam has a high lift cam lobe and each said side cam has a low lift cam lobe.

3. A valve drive mechanism as defined in claim 1, wherein said two side tappet parts are joined by a connecting bridge at which said tappet assembly is engaged by a valve stem of said valve, said connecting bridge being formed with a spring receiving recess in which a return spring is received so as to force said center tappet to return when said center tappet slides relatively to said side tappet.

4. A valve drive mechanism as defined in claim 3, wherein said connecting bridge has an oil spill port formed in a bottom of said spring receiving recess.

5. A valve drive mechanism as defined in claim 3, and further comprising a shim disposed between said connecting bridge and said valve stem.

6. A valve drive mechanism as defined in claim 3, wherein said vertical guide shroud extends along almost the entire vertical length of said center tappet.

7. A valve drive mechanism as defined in claim 3, wherein said locking/unlocking means comprises guide bores formed in each said center tappet and each said side tappet part of said side tappet and being in alignment with one another in said direction of said rotational axis of camshaft, a locking/unlocking pin received for slide movement in said guide bore of said center tappet, a plunger received for slide movement in said guide bore of one of said two side tappet parts of said side tappet, a spring loaded receiver received for slide movement in said guide bore of another of said two side tappet parts of said side tappet, and an oil channel formed in said one side tappet part of said side tappet so as to communicate with said guide bore of said one of said two side tappet parts of said side tappet, through which hydraulic oil is introduced into and removed from said guide bore of said one of said two side tappet parts of said side tappet.

8. A valve drive mechanism as defined in claim 7, and further comprising means for supplying said hydraulic oil into said guide bore of said one of said two side tappet parts through said oil channel so as to force said plunger and said locking/unlocking pin to slide against said spring loaded receiver and to partly enter said guide bores of said center tappet and said other side tappet part of said side tappet, respectively, thereby mechanically coupling said center tappet to said side tappet together and for removing said hydraulic oil from said guide bore of said one of said two side tappet parts through said oil channel so as to cause said plunger and said locking/unlocking pin to slide back by said spring loaded receiver, thereby mechanically uncoupling said center tappet from said side tappet.

9. A valve drive mechanism as defined in claim 7, wherein said locking/unlocking pin is formed with a circumferential recess.

10. A valve drive mechanism as defined in claim 1, and further comprising an oil gallery extending along each of an intake camshaft and an exhaust camshaft, a branch oil channel branching off from said oil gallery and extending between two said tappet assemblies for each twins of twin intake valves and twin exhaust valves per cylinder, an oil channel formed in an outer wall of said side tappet and being in communication with said branch oil channel, and a plunger as a part of said locking/unlocking means incorporated within said tappet assembly, wherein said plunger operates to bring said center tappet and said side tappet into a locked condition when pressure of hydraulic oil is supplied to said plunger from said oil gallery through said oil channel via said branch oil channel and into an unlocked condition when pressure of said hydraulic oil is removed from said plunger.

11. A valve drive mechanism as defined in claim 10, wherein branch oil channel extends to partly overlap outer peripheries of said each twins of said tappet assemblies and said oil channel has a length sufficient to remain communicated with said branch oil channel during up and down movement of said tappet assembly.

12. A valve drive mechanism as defined in claim 11, wherein said branch oil channel is formed by drilling a cylinder head to said oil gallery from one side of said cylinder head and plugged at said one side of said cylinder head.

13. A valve drive mechanism as defined in claim 11, wherein said side tappet of said tappet assembly is formed with a guide bore in which said plunger is received for slide movement, said guide bore being provided with a stopper operative to limit said slide movement of said plunger in said guide bore and to close said guide bore at one end and being in communication with said oil channel through a connecting oil channel.

14. A valve drive mechanism as defined in claim 11, and further comprising a member operative to prevent said tappet assembly from turning relative to said cylinder head, said member being provided on an outer wall of said side tappet at one of opposite sides of said tappet assembly remote from said branch oil chamber.

15. A valve drive mechanism as defined in claim 3, and further comprising retaining means provided between said center tappet and said side tappet for preventing said center tappet from moving up beyond a top of said side tappet by said return spring and however for allowing down movement of said center tappet with respect to said side tappet against said return spring.

16. A valve drive mechanism as defined in claim 15, wherein said retaining means comprises a retaining pin extending between said center tappet and said side tappet, a supporting bore in which said retaining pin is removably received and a limiting recess engageable with said retaining pin which limits said down movement of said center tappet, said supporting bore being formed in either one of said center tappet and said side tappet and said limiting recess being formed in another one of said center tappet and said side tappet.

17. A valve drive mechanism as defined in claim 3, and further comprising an oil gallery extending along each of an intake camshaft and an exhaust camshaft, a branch oil channel branching off from said oil gallery and extending between twins of said tappet assemblies for each twins of twin intake valves and twin exhaust valves per cylinder, an oil channel formed in said side tappet and being in communication with said branch oil channel, and a plunger as a part of said locking/unlocking means incorporated within said tappet assembly, wherein said plunger operates to bring said center tappet and said side tappet into a locked condition when pressure of hydraulic oil is supplied to said plunger from said oil gallery through said oil channel via said branch oil channel and into an unlocked condition when pressure of said hydraulic oil is removed from said plunger.

18. A valve drive mechanism as defined in claim 17, wherein branch oil channel extends such as to partly overlap outer peripheries of said each twins of said tappet assemblies and said oil channel has a length sufficient to remain communicated with said branch oil channel during up and down movement of said tappet assembly.

19. A valve drive mechanism as defined in claim 18, wherein said branch oil channel is formed by drilling a cylinder head to said oil gallery from one side of said cylinder head and plugged at said one side of said cylinder head.

20. A valve drive mechanism as defined in claim 19, wherein said side tappet of said tappet assembly is formed with a guide bore in which said plunger is received for slide movement, said guide bore being provided with a stopper operative to limit said slide movement of said plunger in said guide bore and to close said guide bore at one end and being in communication with said oil channel through a connecting oil channel.

21. A valve drive mechanism as defined in claim 19, and further comprising a member operative to prevent said tappet assembly from turning relative to said cylinder head, said member being provided on an outer wall of said side tappet at one of opposite sides of said tappet assembly remote from said branch oil chamber.

* * * * *